United States Patent [19]

Herrmann

[11] 4,071,777

[45] Jan. 31, 1978

[54] FOUR-QUADRANT MULTIPLIER

[75] Inventor: Eric Peter Herrmann, Bound Brook, N.J.

[73] Assignee: RCA Corporation, New York, N.Y.

[21] Appl. No.: 702,403

[22] Filed: July 6, 1976

[51] Int. Cl.[2] ..... G06G 7/12

[52] U.S. Cl. ..... 307/229; 307/251; 328/160; 364/841

[58] Field of Search ..... 307/229, 251; 328/160; 235/194

[56] References Cited

U.S. PATENT DOCUMENTS

| | | | |
|---|---|---|---|
| 3,368,066 | 2/1968 | Miller et al. | 235/194 |
| 3,562,553 | 2/1971 | Roth | 307/229 |
| 3,588,713 | 6/1971 | Yareck | 328/160 |
| 3,732,406 | 5/1973 | Schlatter | 235/194 |

*Primary Examiner*—Stanley D. Miller, Jr.

*Attorney, Agent, or Firm*—H. Christoffersen; S. Cohen; A. L. Limberg

[57] ABSTRACT

Circuit employing complementary field-effect transistors operated in the triode mode. A signal representing the multiplicand is applied to the gate electrode of one transistor and a signal representing the multiplier is applied to the drain electrode of the same transistor. The complement of the multiplier signal is applied to the drain electrode of the other transistor. A current indicative of the product is available at the common connection of the source electrodes.

8 Claims, 3 Drawing Figures

FOUR-QUADRANT MULTIPLIER

The present invention relates to four-quadrant multipliers employing field-effect transistors and particularly to such multipliers which employ complementary type metal oxide semiconductor (MOS) transistors.

Figure 1:
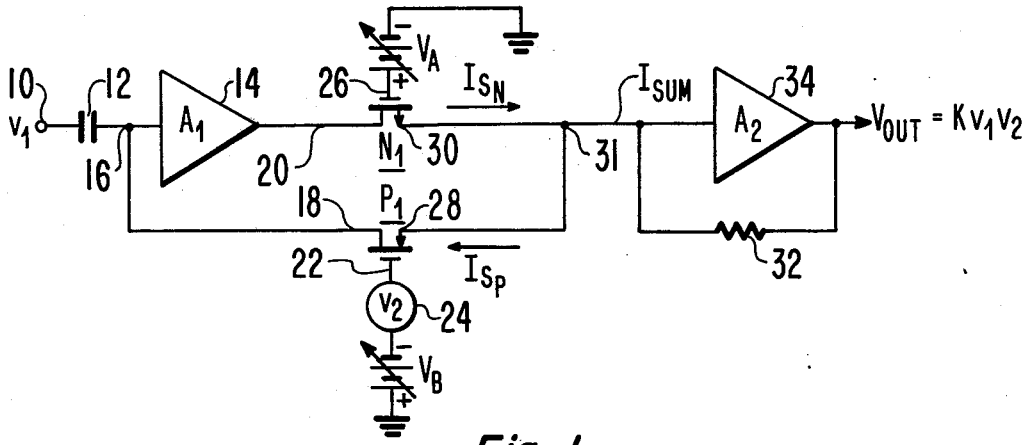
FIG. 1 is a block and schematic circuit diagram of an embodiment of the invention.

Referring to FIG. 1, input signal $V_1$ indicative of a multiplier is applied from input terminal 10 through coupling capacitor 12 to an inverting amplifier 14. Input node 16 of amplifier 14 supplies a composite signal having ac and dc components to the drain electrode 18 of P-type MOS transistor $P_1$. A complementary signal is applied by amplifier 14 to the drain electrode 20 of N-type transistor $N_1$. A dc bias $V_B$, and a signal $v_2$ indicative of a multiplicand, are applied to the gate electrode 22 of transistor $P_1$. The signal source for $v_2$ is represented by a circle 24. Transistor $N_1$ receives a dc bias $V_A$ at its gate electrode 26. The respective bias levels are such that both transistors operate in the triode mode.

The source electrodes 28 and 30 of the respective transistors are connected to common node 31 at which the source currents $I_{S_N}$ and $I_{S_P}$ are summed. Noted that these source currents flow in different directions relative to the node 31. Node 31 connects to a second inverting amplifier 34 with a feedback resistor 32 for maintaining the input node 31 at virtual ground.

The operation of the circuit of FIG. 1 is succinctly described by the equations which follow.

It is known that the drain current $I_{D_P}$ for a transistor such as $P_1$ operated in the triode region is:

$$I_{D_P} = -K_P[(V_{GS_P} + v_{GS_P} - V_{TH_P})(V_{DS_P} + v_{DS_P}) - \tfrac{1}{2}(V_{DS_P} + v_{DS_P})^2] \quad (1)$$

where, in all cases, the subscript $P$ refers to the $P$ type transistor $P_1$ and where:

$K_P$ = a process related and geometric conductance factor $V_{GS_P}$ = the dc component of the gate-to-source voltage $v_{GS_P}$ = the ac component of the gate-to-source voltage $V_{TH_P}$ = the threshold voltage $V_{DS_P}$ = the dc component of the drain-to-source voltage $v_{DS_P}$ = the ac component of the drain-to-source voltage.

Let $V_{GS_P} - V_{TH_P} = V_x$ and assume $V_{DS_P} = 0$ (it will be shown later that this assumption is valid)

$$I_{D_P} = -K_P[(V_x + v_{GS_P})v_{DS_P} - \tfrac{1}{2}v_{DS_P}^2]$$

so that:

$$I_{D_P} = -K_P V_x v_{DS_P} - K_P v_{GS_P} v_{DS_P} + \frac{K_P}{2} V_{DS_P}^2 \quad (2)$$

The drain current $I_{D_N}$ for transistor $N_1$ is (keeping in mind that a signal is not being applied to its gate electrode 26 and assuming that $V_{DS_N}$, the source-to-drain dc component is zero):

$$I_{D_N} = +K_N[V_y v_{DS_N} - \tfrac{1}{2}v_{DS_N}^2] \quad (3)$$

where:

$V_y - V_{GS_N} - V_{TH_N}$ $K_N$ = a process related and geometric conductance factor for transistor $N_1$ $V_{GS_N}$ = the dc component of the gate-to-source voltage of transistor $N_1$ $V_{TH_N}$ = threshold voltage of transistor $N_1$ $v_{DS_N}$ = the ac component of the drain-to-source voltage of transistor $N_1$ $$|V_{GS_N}| > |V_{TH_N}|$$

By inspection:

$$I_{SUM} = I_{S_P} + I_{S_N} \quad (4)$$

$$I_{S_P} = I_{D_P} \quad (5)$$

$$I_{S_N} = I_{D_N} \quad (6)$$

where:

$I_{S_P}$ = source current of $P_1$ $I_{S_N}$ = source current of $N_1$

Substituting equations (2), (3), (5) and (6) into equation (4) gives:

$$I_{SUM} = -K_P V_x v_{DS_P} - K_P v_{GS_P} v_{OS_P} + K_N V_y v_{DS_N} - \tfrac{1}{2}K_N v_{DS_N}^2 + \tfrac{1}{2}K_P v_{DS_P}^2 \quad (7)$$

which simplifies to:

$$I_{SUM} = \overset{\alpha}{K_N V_y v_{DS_N} - K_P V_x v_{DS_P}} + \overset{\beta}{\tfrac{1}{2}(K_P v_{DS_P}^2 - K_N v_{DS_N}^2)} - K_P v_{GS_P} v_{DS_P} \quad (8)$$

In the ideal case, $K_P = K_N$ $V_x = -V_y$ $V_{DS_P} = v_{DS_N}$ so that the $\alpha$ and $\beta$ terms cancel leaving the desired product term $K_P v_{GS_P} v_{DS_P}$.

For the non-ideal case, gain adjustment of amplifier $A_1$ can be employed to zero the $\beta$ term, and adjustment of the dc component at the gate electrode of the P or N type transistor can be employed to zero the $\alpha$ term.

While in the embodiment of FIG. 1, the multiplicand is applied only to the gate electrode 22 of a P-type transistor $P_1$, in a modified form of the circuit a signal complementary thereto, that is $\bar{v}_2$, can be applied to the gate electrode 26 of N-type transistor $N_1$.

In equation 8 above, the product term $K_p v_{GS_P} v_{DS_P}$ is a current proportional to the product $v_1 v_2$, with $K_p$ a constant. The function of the output amplifier 34 is to translate this current to a voltage $K v_1 v_2$, where K is a constant.

Figure 2:
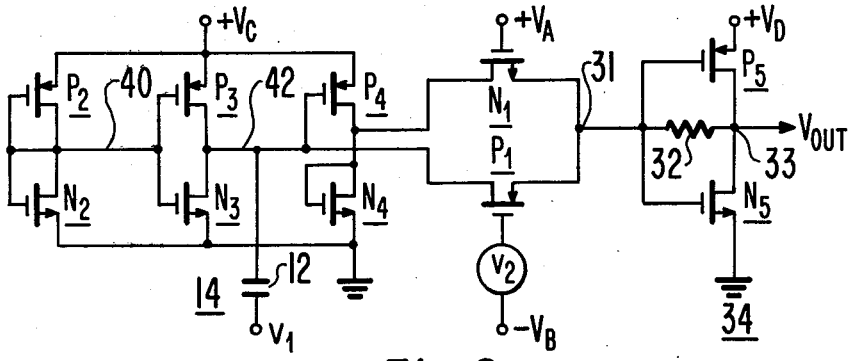
FIG. 2 is a schematic circuit diagram of the multiplier of FIG. 1.

The circuit of FIG. 2 is a complementary symmetry metal oxide semiconductor (COS/MOS) realization of the circuit of FIG. 1. All transistors are of the enhancement type. Inverter pair $P_2$, $N_2$, with each transistor connected gate electrode-to-drain electrode, serves as a biasing means for holding the common gate connection 40 of the following transistor pair $P_3$, $N_3$ at a desired dc voltage level. In a preferred form of the invention, transistors $N_2$ and $P_2$ are matched as are transistors $P_3$ and $N_3$, and $P_4$ and $N_4$, that is, all of these transistors are fabricated to have the same conduction path impedance in response to corresponding operating voltages. As transistors $P_2$ and $N_2$ are matched, the common gate electrode connection 40 is at a dc level $V_C/2$. The COS/MOS inverter $P_3$, $N_3$ is interconnected with the diode-connected transistor $P_2$, $N_2$ to form a COS/MOS current mirror amplifier. The quiescent or dc output voltage at the interconnected drain electrodes (connection 42) of this amplifier is $V_C/2$. These drain electrodes connect to the gate electrode of transistor $P_4$, which operates as an inverter. Transistor $N_4$, which is connected at its source electrode to ground and at its common drain-gate electrode connection to the drain electrode of transistor $P_4$, serves as a resistive load for transistor $P_4$.

The multiplier signal $v_1$ is applied through capacitor 12 to common connection 42 at the drain electrode of the multiplying transistor $P_1$. Note that the voltage at 42 includes a dc component $V_C/2$ and an ac component $v_1$. An ac signal complementary to $v_1$ appears at the drain electrode to transistor $P_4$ and is applied to the drain electrode of transistor $N_1$. Note that here also there is a dc component $V_C/2$ as well as the ac component.

The output inverting amplifier $A_2$ comprises a further COS/MOS matched pair $P_5$, $N_5$. The feedback resistor 32 is connected between the common drain electrode connection 33 and the common gate electrode connection 31. Connected in this way, the amplifier $P_5$, $N_5$ is biased to the same dc level as are the amplifiers $P_3$, $N_3$ and $P_4$, $N_4$, assuming $V_D = V_c$. Under these conditions, the drain electrodes of transistors $N_1$ and $P_1$ are at the same dc potential as their source electrodes so that the assumption made ($V_{DS_P}=0$) in deriving equation 2 is valid and holds also for N-type transistor $N_1$. If the transistors are not perfectly matched, the dc component just discussed can be eliminated by differential adjustment of the operating voltages $V_C$ and $V_D$, assuming, as is the case in practice, that the impedance looking into the source electrodes of the transistor pair $N_1$, $P_1$ is high compared to the dc impedance looking into the amplifier $P_5$, $N_5$. In practice, of course, $V_C$ and $V_D$ can be a common voltage source provided with some differential means of adjustment such as a variable resistor in one or both power supplies leads.

Figure 3:
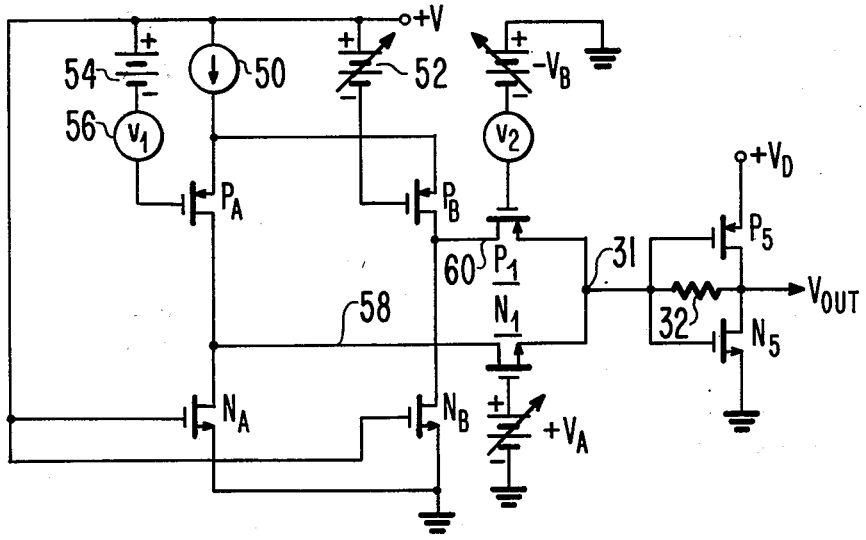
FIG. 3 is a schematic circuit diagram of a second embodiment of the invention.

In the embodiment of the invention illustrated in FIG. 3, a differential amplifier is employed for obtaining the complementary signals. The amplifier comprises two MOS pairs $P_A$, $N_A$ and $P_B$, $N_B$. Both pairs receive supply current from a common current source 50. The gate electrode of the transistor $P_B$ of the second pair is maintained at a dc reference voltage level. The reference voltage source is indicated schematically by a battery 52 but it may be obtained by a circuit which includes a Zener diode or by a circuit comprising a string of series connected diodes between two operating voltage terminals with a tap being taken from a suitable place along the diode string. The same holds for source 54 which provides the dc bias for the gate electrode of transistor $P_A$ of the first pair. The latter gate electrode also receives the ac multiplier signal $v_1$ from source 56.

The operation of the circuit of FIG. 3 is believed to be self-evident from the description which already has been given. When an ac signal $v_1$ is present, the current from source 50 will divide among the two branches of the differential amplifier in accordance with the amplitude and polarity of the signal. For example, as $v_1$ goes more positive, current flow through transistor $P_A$ decreases and the ac signal component at node 58, which is supplied to the drain of transistor $N_1$, becomes less positive. Correspondingly, the ac signal component appearing on lead 60, which is applied to the drain electrode of transistor $P_1$ becomes more positive. In other words, the signals on leads 58 and 60 are complementary to one another, the one on lead 60 being of the same polarity as the input signal and the one on lead 58 being complementary thereto. This is similar to what occurs in the circuit of FIGS. 1 and 2. The remainder of the circuit operation is the same as discussed in connection with FIGS. 1 and 2.

It is known in the art to employ field-effect transistors of the same conductivity type (as contrasted to the complementary conductivity type transistors $P_1$, $N_1$ used here) to provide a four-quadrant multiplication. Patents showing representative multipliers employing such structure are U.S. Pat. No. 3,562,553 to Roth and U.S. Pat. No. 3,368,066 to Miller et al. However, these prior circuits require a differential amplifier, such as shown at 80 in Roth, for combining the outputs of the multiplying transistors with one another to obtain the product signal, whereas in the present application the addition takes place at a common connection 31. A differential amplifier limits the bandwidth of the circuit. For example, it is expected that the circuits of the present FIG. 3 can be operated in the 20 MHz range and the same would hold for the prior art circuit which require a differential amplifier to combine currents. On the other hand, the circuit of FIG. 2 is expected to operate in the 60 MHz range. Further, the use of a differential amplifier introduces possible problems of common mode rejection.

Another feature of the present circuit is that it is easily compatible with a system which employs complementary transistors in other portions of the system. This is especially useful where integration of all circuits on a common semiconductor substrate is desired as the manufacturing steps are the same for the multiplying transistors $N_1$ and $P_1$ as for the remaining transistors.

What is claimed is:

1. A multiplier for developing a product signal proportional to a multiplicand signal multiplied by multiplier signal comprising, in combination:

first and second field effect transistors respectively of first and second conductivity types complementary to each other, each having source and drain electrodes and a channel therebetween and having a gate electrode;

means for maintaining the source electrodes of said first and second transistors at a reference potential;

means for applying to the drain electrode of said first transistor a first drain potential having a direct component equal to said reference potential and having a component indicative of said multiplier signal superimposed on its direct component;

means for applying to the gate electrode of said first transistor a first gate potential having a direct component for operating said first transistor in its triode region and having a component indicative of said multiplicand signal superimposed on its direct component;

means for applying to the drain electrode of said second transistor a second drain potential having a direct component equal to said reference potential and having a component indicative of said multiplier signal superimposed on its direct component, the components of said first and second drain potentials indicative of said multiplier signal being complementary or anti-phase to each other;

means for applying to the gate electrode of said second transistor a second gate potential for operating said second transistor in its triode region; and means connected to additively combine the currents flowing in the channels of said first and second field effect transistors responsive to the potentials applied to them to derive said product signal substantially free of first-order and second-order multiplier signal terms.

2. A multiplier as set forth in claim 1 wherein at least one of said means for applying a first gate potential and said means for applying a second gate potential includes means for adjusting the direct component of the gate potential it applies to null first-order multiplier signal terms from said product signal.

3. A multiplier as set forth in claim 1 wherein at least one of said means for applying a first drain potential and said means for applying a second drain potential includes an adjustable gain amplifier for adjusting the relative amplitudes of the components of said first and second drain potentials indicative of said multiplier signal to null second-order multiplier signal terms in said product signal.

4. A multiplier as set forth in claim 3 wherein at least one of said means for applying a first gate potential and said means for applying a second gate potential includes means for adjusting the direct component for adjusting the gate potential it applies to null first-order multiplier signal terms from said product signal.

5. A multiplier as set forth in claim 1 wherein said means connected to additively combine the currents flowing in the channels of said first and second transistors is an output amplifier, having an input terminal maintained at said reference potential, to which input terminal the source electrodes of said first and said second transistors connect, and having an output terminal at which said product signal is available.

6. A multiplier as set forth in claim 5 including:

third and fourth field effect transistors of said first and second conductivity types, respectively, each having source and drain and gate electrodes;

means connecting said third and fourth transistors as said output amplifier, including a connection of the gate electrodes of said third and fourth transistors to the input terminal of said amplifier, a connection of the drain electrodes of said third and said fourth transistors to the output terminal of said amplifier, a feedback resistor connected between the output and input terminals of said output amplifier, and means for applying a first operating potential between the source electrodes of said third and fourth transistors;

fifth and sixth field effect transistors of said first and said second conductivity types, respectively, each having source and drain and gate electrodes;

means connecting said fifth and said sixth field effect transistors as a signal-inverting amplifier, including an input terminal connected to the gate electrode of said fifth transistor for receiving a potential with a dc component upon which said multiplier signal is superimposed, an output terminal having the drain electrodes of said fifth and sixth field effect transistors and the gate electrode of said sixth transistor connected thereto, and means for applying a second operating potential between the source electrodes of said fifth and sixth transistors, said first and second operating potentials being adjustable with respect to each other for nulling multiplier signal terms in said product signal; and connections of the input and output terminals of said signal inverting amplifier to separate ones of the drain electrodes of said first and second transistors, thereby providing the means for applying said first drain potential and the means for applying said second drain potential.

7. A multiplier as set forth in claim 6 wherein the multiplier signal is coupled via a capacitor to the input terminal of said signal inverting amplifier and wherein a direct component of potential is applied to the input terminal of said signal inverting amplifier by means comprising:

seventh and eighth field effect transistors of a first conductivity type and ninth and tenth field effect transistors of a second conductivity type, each having source and drain and gate electrodes;

connection of the source electrodes of said seventh and eighth transistors to the source electrode of said fifth transistor;

connection of the source electrodes of said ninth and tenth transistors to the source electrode of said sixth transistor;

connection of the drain electrodes of said seventh and ninth transistors to the input terminal of said inverting amplifier; and an interconnection between the drain electrodes of said eighth and tenth transistors, which interconnection is connected to the gate electrodes of said seventh, eighth, ninth and tenth transistors.

8. A multiplier as set forth in claim 1 including:

third and fourth field effect transistors of one of said first and second conductivity types and fifth and sixth field effect transistors of the other of said first and second conductivity types, each having source and drain and gate electrodes;

means connecting said third, fourth, fifth and sixth transistors in bridge connection including a first interconnection between the drain electrodes of said third and fifth transistors connected to the drain electrode of said first transistor, a second interconnection between the drain electrodes of said fourth and sixth transistors connected to the drain electrode of said second transistor, a third interconnection between the source electrodes of said third and fourth transistors, a fourth interconnection between the source electrodes of said fifth and sixth transistors, constant current generator means connected to apply current to said third interconnection, means for applying a direct potential to said fourth interconnection, means for applying gate potentials to said third and fourth transistors including (a) means for adjusting the direct component of one of the gate potentials of said third and fourth transistor vis-a-vis the other and (b) means for applying said multiplier signal differentially between the gate electrodes of said third and fourth transistors, and means for applying gate potentials to said fifth and sixth transistors to bias them into conduction.

* * * * *